US005749023A

United States Patent [19]

Grace et al.

[11] Patent Number: 5,749,023

[45] Date of Patent: May 5, 1998

[54] ADAPTIVE FEED FORWARD COMPENSATION FOR TIME VARYING TONER COHESIVITY

[75] Inventors: Robert E. Grace; Guru B. Raj, both of Fairport; James M. Pacer, Webster, all of N.Y.

[73] Assignee: Xerox Corporation, Stamford, Conn.

[21] Appl. No.: 832,927

[22] Filed: Apr. 4, 1997

[51] Int. Cl.[6] ..... G03G 15/10

[52] U.S. Cl. ..... 399/58; 399/49

[58] Field of Search ..... 399/49, 58, 60, 399/29

[56] References Cited

U.S. PATENT DOCUMENTS

| | | | |
|---|---|---|---|
| 4,686,542 | 8/1987 | Yip et al. . | |
| 4,734,737 | 3/1988 | Koichi | 399/58 |
| 5,081,494 | 1/1992 | Reed et al. . | |
| 5,091,971 | 2/1992 | Ward et al. . | |
| 5,298,960 | 3/1994 | Fukuchi et al. | 399/29 |
| 5,469,244 | 11/1995 | Ogata et al. | 399/58 X |

FOREIGN PATENT DOCUMENTS

| | | |
|---|---|---|
| 6-110285 | 4/1994 | Japan . |
| 7-295312 | 11/1995 | Japan . |
| 8-248748 | 9/1996 | Japan . |

*Primary Examiner*—S. Lee
*Attorney, Agent, or Firm*—Ronald F. Chapuran

[57] ABSTRACT

A method of compensating for toner cohesivity within a repository in a developer system by recording toner consumption rate and toner dispense rate over a given time within the developer system. A control responds to the toner consumption and dispense rates over the given time period to compute toner residence time in the repository and estimate a degree of toner cohesiveness. The control then projects an adjustment to the development voltage to suppress the effects of toner cohesivity.

9 Claims, 4 Drawing Sheets

ADAPTIVE FEED FORWARD COMPENSATION FOR TIME VARYING TONER COHESIVITY

BACKGROUND OF THE INVENTION

The invention relates to developability and transfer efficiency in xerographic systems, and more particularly, to adaptive feed forward compensation for time varying toner cohesivity.

In xerographic systems employing donor roll development (Hybrid Scavengeles (HSD), Hybrid Jumping (HJD), scavengeless electroded (SED), for example), toner cohesivity can affect the ability of toner to be developed from the donor roll to the photoreceptor and the ability of toner to transfer from the photoreceptor to media. Toner cohesivity (the tendency of toner particles to stick together) is a time-varying phenomenon, and tends to increase as a function of toner residence time in the developer housing. This effect produces a decline in developability (and transfer) when toner throughput is lower than normal. This effect has conventionally been taken as a noise factor to the process controller. Test patches are generated and sampled at a high enough rate to track all significant changes in developability, and development potential (Vdev) is adjusted based on the patch values. For small developer housings, the range of residence time values and the rate of change of residence time can be large and the needed patch sampling rate is high. This produces undesirable toner consumption and patch scheduling impacts, and can impact overall productivity.

It would be desirable, therefore, to overcome the above identified problem of toner cohesiveness by compensating within a controller for the tendency toward toner cohesiveness. In accordance with the present invention, a feed forward control technique rapidly compensates for variations in toner cohesivity, which can cause variations in developability in donor roll development systems. Since cohesivity increases as toner residence time in a housing increases, the residence time distribution can be determined from the dispense rate and pixel count data already available to a controller. The sequence of control steps at any point in time would be to first calculate the toner residence rime distribution, then project the toner cohesiveness, then project the needed adjustment in development potential to suppress any undesirable developability effect. Test patches could be used for feedback control of algorithm coefficients using a relatively low sampling frequency. Advantages are a more rapid response to disturbances and reduced patch toner consumption.

It is an object of the present invention therefore to provide a new an improved technique for toner cohesiveness compensation by utilizing data on toner consumption rate and toner dispense rate. It is another object of the present invention to be able to compute toner residence time distribution and to project toner cohesiveness. It is still another object of the present invention to be able to project toner cohesiveness and to provide suitable adjustment to development voltage. Other advantages of the present invention will become apparent as the following description proceeds, and the features characterizing the invention will be pointed out with particularity in the claims annexed to and forming a part of this specification.

SUMMARY OF THE INVENTION

The present invention is concerned with a method of compensating for toner cohesivity within a repository in a developer system by recording toner consumption rate and toner dispense rate over a given time within the developer system. A control responds to the toner consumption and dispense rates over the given time period to compute toner residence time in the repository and estimate a degree of toner cohesiveness. The control then projects an adjustment to the development voltage to suppress the effects of toner cohesivity.

For a better understanding of the present invention, reference may be had to the accompanying drawings wherein the same reference numerals have been applied to like parts and wherein:

DETAILED DESCRIPTION OF THE DRAWINGS

DETAILED DESCRIPTION OF THE PREFERRED EMBODIMENT

Figure 1:
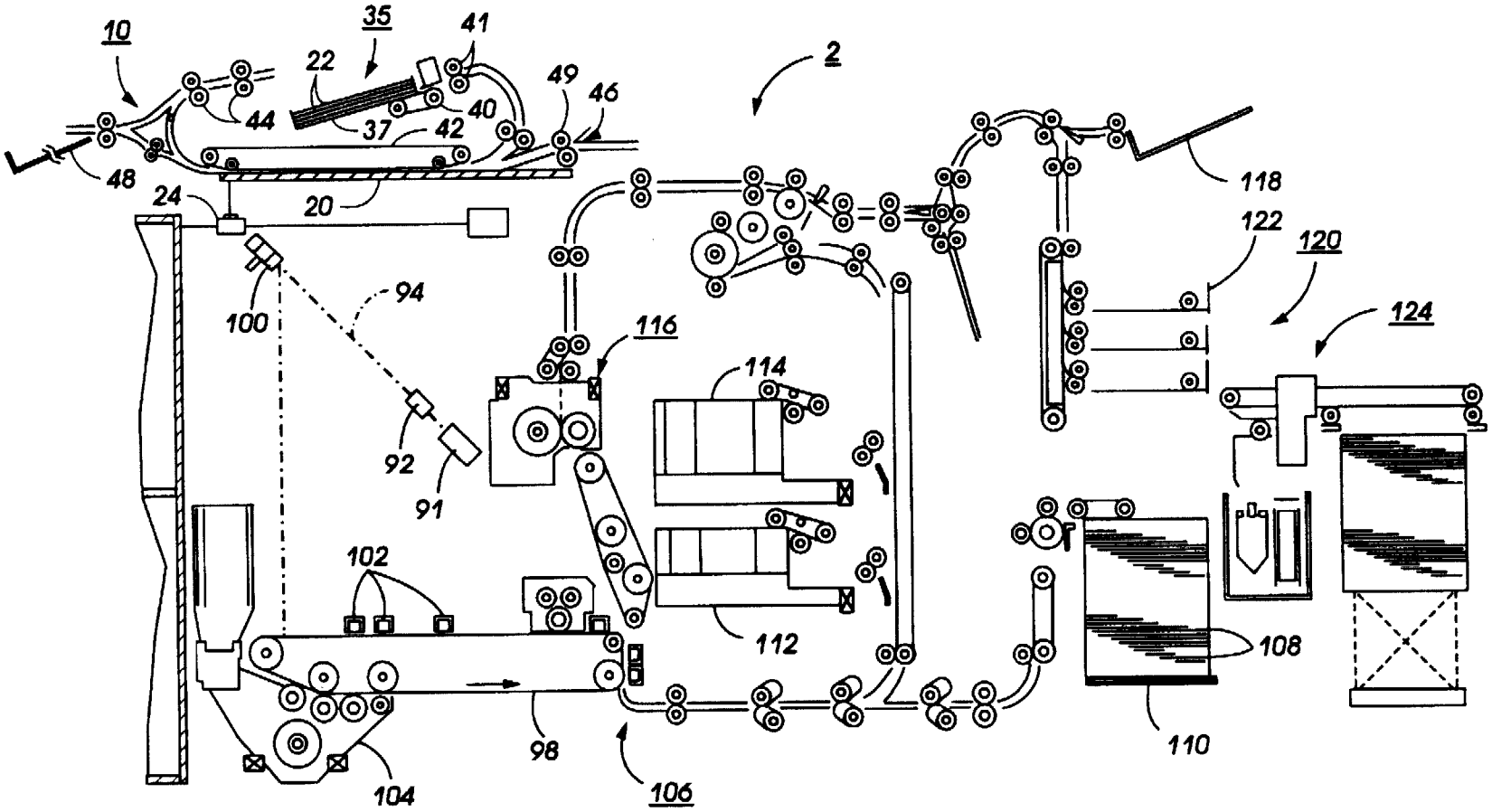
FIG. 1 is a plan view illustrating a typical electronic imaging system incorporating toner reduction to maximizing process latitude.
Figure 2:
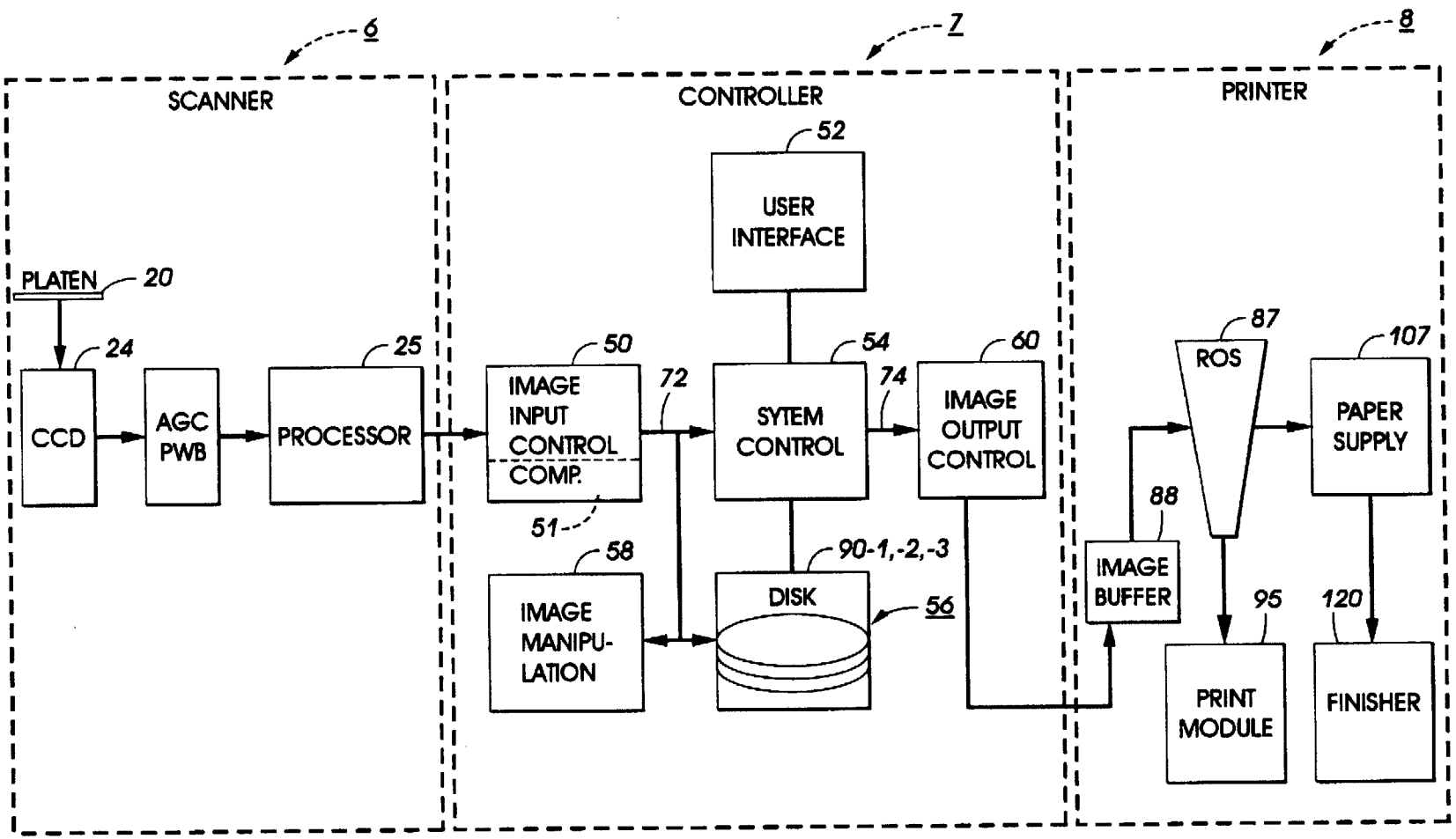
FIG. 2 is a block diagram depicting the major elements of the imaging system shown in FIG. 1.

Referring to FIGS. 1 and 2, there is shown an exemplary electronic imaging system 2 in accordance with the teachings of the present invention. Imaging system 2, for purposes of explanation, is divided into a scanner section 6, controller section 7, and printer section 8. While a specific printing system is shown and described, the present invention may be used with other types of printing systems, such as ionographic, etc.

Scanner section 6 incorporates a transparent platen 20 on which the document 22 to be scanned is located. One or more linear arrays 24 are supported for reciprocating scanning movement below platen 20. A suitable (not shown) lens and mirrors cooperate to focus the array 24 on a line-like segment of platen 20 and the document being scanned thereon. Array 24 provides image signals or pixels representative of the image scanned which after suitable processing by processor 25, are output to controller section 7.

Processor 25 converts the analog image signals output by array 24 to digital and processes the image signals as required to enable system 2 to store and handle the image data in the form required to carry out the job programmed. Processor 25, for example, may provide enhancements and changes to the image signals such as filtering, thresholding, screening, cropping, etc.

Documents 22 to be scanned may be located on platen 20 for scanning by automatic document handler (ADF) 35, operable in either a Recirculating Document Handling (RDH) mode or a Semi-Automatic Document Handling (SADH) mode. A manual mode including a Book mode and a Computer Forms Feeder (CFF) mode are also provided, the latter to accommodate documents in the form of computer fanfold. For RDH mode operation, document handler 35 has a document tray 37 in which documents 22 are arranged in stacks or batches. The documents 22 in tray 37 are advanced by vacuum feed belt 40 and document feed rolls 41 and document feed belt 42 onto platen 20 where the document is scanned by array 24. Following scanning, the document is removed from platen 20 by belt 42 and returned to tray 37 by document feed rolls 44

Printer section 8 comprises a laser type printer and, for purposes of explanation, is separated into a Raster Output Scanner (ROS) section 87 with image buffer electronics 88. Print Module Section 95, Paper Supply section 107, and Finisher 120. ROS 87 has a laser 91, the beam of which is split into two imaging beams 94. Each beam 94 is modulated in accordance with the content of an image signal input by acousto-optic modulator 92 to provide dual imaging beams 94. Beams 94 are scanned across a moving photoreceptor 98 of Print Module 95 by the mirrored facets of a rotating polygon 100 to expose two image lines on photoreceptor 98 with each scan and create the latent electrostatic images represented by the image signal input to modulator 92. Photoreceptor 98 is uniformly charged by corotron 102 at a charging station preparatory to exposure by imaging beams 94. It should be noted that it is within the scope of the present invention to use any type of image receiving member or surface or projecting system as appropriate for example, for ionographic systems.

The latent electrostatic images are developed by developer 104 and transferred at transfer station 106 to a print media 108 delivered by Paper Supply section 107. Media 108, as will appear, may comprise any of a variety of sheet sizes, types, and colors. For transfer, the print media is brought forward in timed registration with the developed image on photoreceptor 98 from either a main paper tray 110 or from auxiliary paper trays 112 or 114. The developed image transferred to the print media 108 is permanently fixed or fused by fuser 116, and the resulting prints discharged to either output tray 118, or to finisher 120. Finisher 120 could include a stitcher 122 for stitching or stapling the prints together to form books and a thermal binder 124 for adhesively binding the prints into books.

Controller section 7 is, for explanation purposes, divided into an image input controller 50, User Interface (UI) 52, system controller 54, main memory 56, image manipulation section 58 and image output controller 60. The scanned image data input from processor 25 of scanner section 6 to controller section 7 is compressed by image compressor/processor 51 of image input controller 50. As the image data passes through compressor/processor 51, it is segmented into slices N scanlines wide, each slice having a slice pointer. The compressed image data together with slice pointers and any related image descriptors providing image specific information (such as height and width of the document in pixels, the compression method used, pointers to the compressed image data, and pointers to the image slice pointers) are placed in an image file. The image files, which represent different print jobs, are temporarily stored in a not shown system memory which comprises a Random Access Memory or RAM pending transfer to main memory 56 where the data is held pending use.

UI 52 includes a combined operator controller/CRT display consisting of an interactive touchscreen, keyboard, and mouse. UI 52 interfaces the operator with printing system 2, enabling the operator to program print jobs and other instructions, to obtain system operating information, instructions, programming information, diagnostic information, etc. Items displayed on the touchscreen such as files and icons are actuated by either touching the displayed item on the screen with a finger or by using a mouse to point a cursor to the item selected and keying the mouse. Main memory 56 has plural hard disks 90-1, 90-2, 90-3 for storing machine Operating System software, machine operating data, and the scanned image data currently being processed.

When the compressed image data in main memory 56 requires further processing, or is required for display on the touchscreen of UI 52, or is required by printer section 8, the data is accessed in main memory 56. Where further processing other than that provided by processor 25 is required, the data is transferred to image manipulation section 58 where the additional processing steps such as collation, make ready, decomposition, etc. are carried out. Following processing, the data may be returned to main memory 56, sent to UI 52 for display, or sent to image output controller 60.

Image data output to image output controller 60 is decompressed and readied for printing by not shown image generating processors. Following this, the data is output by suitable dispatch processors to printer section 8. Image data sent to printer section 8 for printing is normally purged from memory 56 to make room for new image data. Within Printer 8, image data is buffered and synchronized within Image buffer Electronics 88 for delivery to and modification within the RO 87. For additional control detail, reference is made to U.S. Pat. Nos. 5,081,494, 5,091,971 and 4,686,542 incorporated herein.

If a process controller obtains information about toner consumption rate (pixel count) and the toner dispense rate over any arbitrary interval, in accordance with the present invention, this information can be stored as an array and processed. It is then possible to compute the toner residence time distribution in the developer housing at any instant. The computed average residence time (or some higher order metric of the distribution) can be used to project or predict toner cohesiveness. Toner cohesiveness, in turn, can be used to project a needed adjustment in development voltage to suppress any observed effect (that is, to maintain constant solid area DMA). The voltage adjustment can be fed forward to the controller. Test patches can monitor the effectiveness of suppression, and provide data with which to adjust algorithm coefficients (adaptively), but the patch generation and sampling frequency needed to enable benchmark performance are many times lower than with the conventional approach.

The feed-forward approach has three advantages. Disturbances due to time-varying toner cohesiveness are suppressed before they affect image quality, so performance is improved and the noise factors driving control variability are reduced. Patch toner consumption is reduced, giving the end user more prints per unit mass of color toner. Product productivity impacts due to patch scheduling (such as excessive skipped pitches) are reduced or eliminated. This method of adaptive feed-forward compensation for time-varying toner cohesivity in general produces a significant advantage in image quality stability or patch sampling rate, or both.

Figure 3:
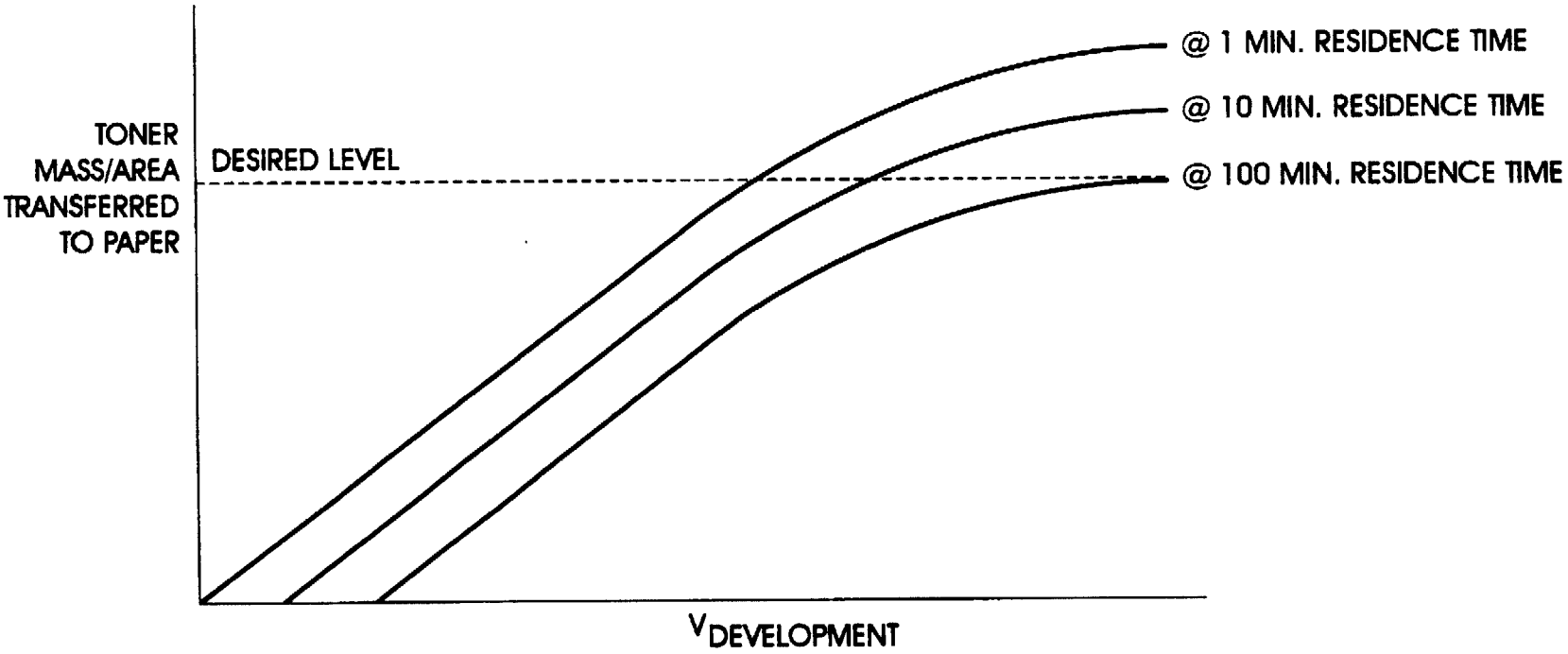
FIG. 3 is a curve illustrating effects of toner cohesivity.
Figure 4:
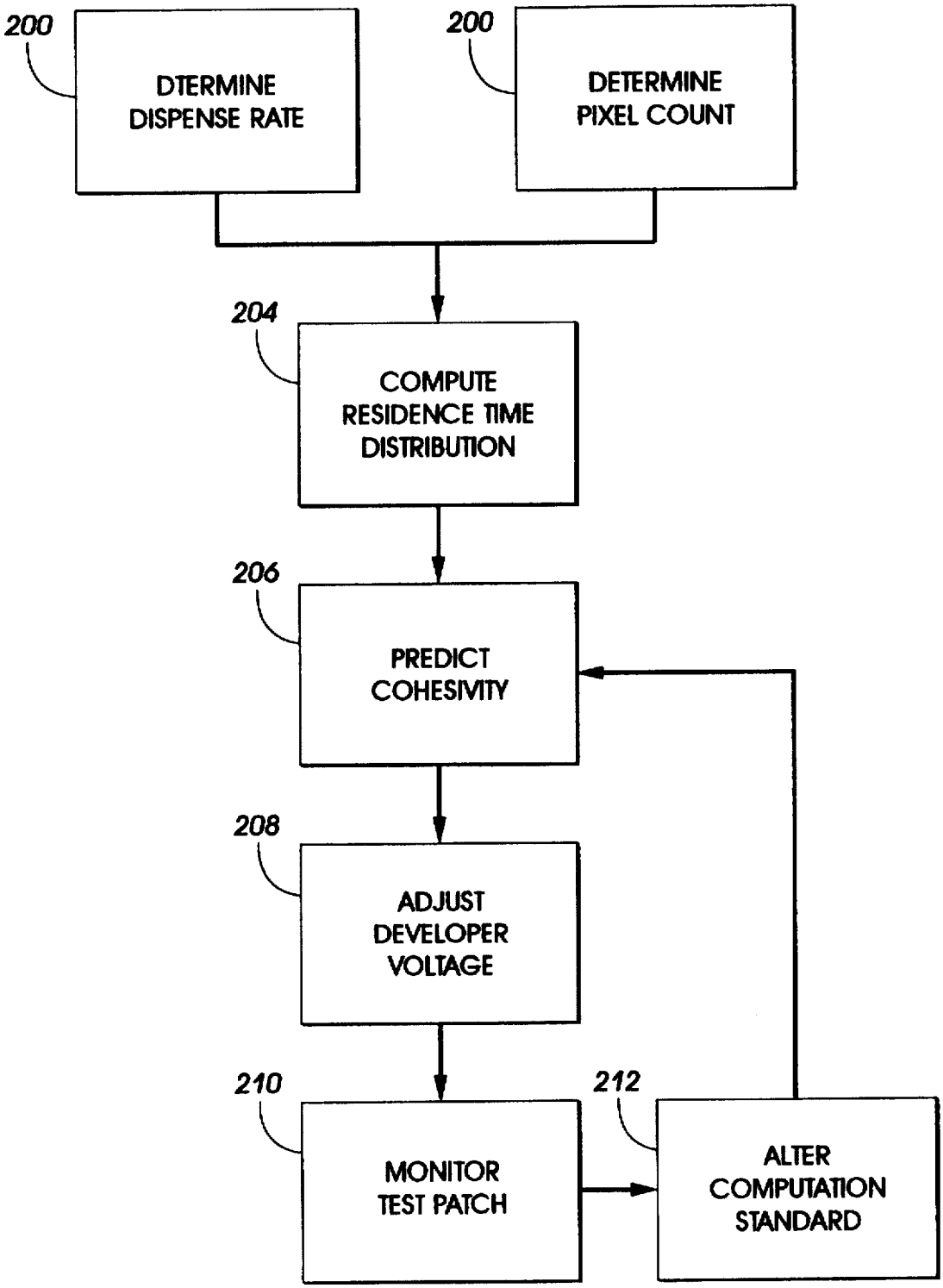
FIG. 4 is a flow chart illustrating adaptive feed forward compensation for time varying toner cohesivity in accordance with the present invention.

FIG. 3 is an illustration of the tendency of toner particles to stick together as a function of the toner residence time in a developer housing. As discussed above, this effect produces a decline in developability and transfer of the toner particles, particularly when toner throughput is lower than normal. FIG. 4 is a general flow chart illustrating the technique, in accordance with the present invention, of adaptively compensating for time varying toner cohesivity.

In particular, both a dispense rate and a pixel count over a given period of time are determined and shown in blocks 200 and 202. The time period could be a set time period or could be a variable time period depending upon machine usage. The initiation of the time period could be based upon machine usage such as the completion of a job or after the completion of a set number of jobs, or even at set real time intervals. This, however, is a design option and it should be understood that the length of the interval, the frequency of the determination of dispense rate and pixel count, and the precise time of initiation of the time interval can be based upon various factors such as expected machine usage and type of usage.

At some point, as illustrated at block 204, there is a computation or determination of the residence time distribution of toner within the housing. That is, there is some determination of an average length of time of residence of toner within the toner housing. Based upon this determination, there is a calculation made or prediction of the toner cohesivity as shown at block 206. Based on the predicted toner cohesivity, as shown in block 208, an appropriate adjustment is made to the developer voltage to compensate for such toner cohesivity. Finally, suitable test patches are developed and sensed to monitor and compare the adjustments made to the developer voltage with the toner mass of a toner patch. This measured developed density can then be used to alter the computation standard or basis used to predict the cohesivity in block 206. It should also be understood that there are other options of feedback to adjust the cohesivity prediction such as altering the formula or method for computing the residence time distribution as shown in block 204. At any rate, an appropriate step in the prediction cycle is some way to monitor the results of the adjustment to developer voltage to track the correctness of the computed residence time distribution and cohesivity predictor in order to be able to adjust the system as necessary.

While there has been illustrated and described what is at present considered to be a preferred embodiment of the present invention, it will be appreciated that numerous changes and modifications are likely to occur to those skilled in the art, and it is intended to cover in the appended claims all those changes and modifications which fall within the true spirit and scope of the present invention.

We claim:

1. In a machine having a moving imaging surface, a projecting system projecting an image onto the imaging surface, a developer for application of toner to the image projected onto the imaging surface for transfer of the image to a medium, the developer being responsive to a development voltage and including a repository of toner to be applied to the image, a method of compensating for toner cohesivity within the repository comprising the steps of;

recording toner consumption rate and toner dispense rate over a given time period, responsive to the toner consumption rate and toner dispense rate over the given time period, computing toner residence time in the repository, based upon average toner residence time in the repository, estimating a degree of toner cohesiveness, and responsive to estimating the degree of toner cohesiveness, projecting an adjustment to the development voltage to suppress the effects of toner cohesivity.

2. The method of claim 1 wherein the step of recording toner consumption rate includes the step of counting projected image pixels.

3. The method of claim 1 wherein the step of computing toner residence time in the repository includes the step of computing average toner residence time.

4. The method of claim 1 wherein the given time period is any arbitrary time interval.

5. The method of claim 1 including the step of periodically generating and sampling test patches to monitor the effects of toner cohesivity suppression.

6. The method of claim 1 wherein the repository of toner is a relatively small repository.

7. In a machine having a moving imaging surface, a projecting system projecting an image onto the imaging surface, a developer for application of toner to the image projected onto the imaging surface for transfer of the image to a medium, the developer being responsive to a development voltage and including a repository of toner to be applied to the image, a method of compensating for toner cohesivity within the repository comprising the steps of;

recording toner consumption rate and toner dispense rate over a given time period including the step of counting projected image pixels, responsive to the toner consumption rate and toner dispense rate over the given time period, computing average toner residence time in the repository, based upon average toner residence time in the repository, estimating a degree of toner cohesiveness, responsive to estimating the degree of toner cohesiveness, projecting an adjustment to the development voltage to suppress the effects of toner cohesivity, and periodically generating and sampling test patches to monitor the effects of toner cohesivity suppression.

8. In a machine having a moving imaging surface, a projecting system projecting an image onto the imaging surface, a developer for application of toner to the image projected onto the imaging surface for transfer of the image to a medium, the developer being responsive to a development voltage and including a repository of toner to be applied to the image, a method of compensating for toner cohesivity within the repository comprising the steps of:

recording toner consumption rate and toner dispense rate over a given time period including the step of counting projected image pixels, responsive to the toner consumption rate and toner dispense rate over the given time period, computing average toner residence time in the repository, based upon average toner residence time in the repository, estimating a degree of toner cohesiveness, and responsive to estimating the degree of toner cohesiveness, projecting an adjustment to the development voltage to suppress the effects of toner cohesivity.

9. The method of claim 8 including the step of periodically generating and sampling test patches to monitor the effects of toner cohesivity suppression.

* * * * *